US005349323A

United States Patent [19]

Shigemoto et al.

[11] Patent Number: 5,349,323

[45] Date of Patent: Sep. 20, 1994

[54] SEESAW MANIPULATION-TYPE VARIABLE RESISTOR

[75] Inventors: Hideki Shigemoto, Moriguchi; Hiroshi Matsui, Hirakata, both of Japan

[73] Assignee: Matsushita Electric Industrial Co., Ltd., Kadoma, Japan

[21] Appl. No.: 73,941

[22] Filed: Jun. 10, 1993

[30] Foreign Application Priority Data

Jun. 11, 1992 [JP] Japan ..... 4-151722

[51] Int. Cl.[5] ..... H01C 10/38

[52] U.S. Cl. ..... 338/176; 338/184

[58] Field of Search ..... 338/176, 155, 74, 184, 338/128, 183, 153

[56] References Cited

U.S. PATENT DOCUMENTS 3,639,880 2/1972 Oka ..... 338/183
4,131,870 12/1978 Hilgendorf et al. ..... 338/183
4,139,831 2/1979 Ortlieb et al. ..... 338/128
4,380,002 4/1983 Neill et al. ..... 338/153
4,533,805 8/1985 Fujinami et al. ..... 338/176 X
4,795,952 1/1989 Brandstetter ..... 338/128 X

FOREIGN PATENT DOCUMENTS 57-173229 11/1982 Japan .
62-57372 3/1987 Japan ..... H04N 5/232

*Primary Examiner*—Marvin M. Lateef
*Attorney, Agent, or Firm*—Cushman, Darby & Cushman

[57] ABSTRACT

A seesaw manipulation-type variable resistor is provided which has a linear sliding-type variable resistor unit. A U-shaped groove in a below-extended arm of a manipulation key smoothly interlink with a coupling member of a linear sliding-type variable resistor. A position restoring leaf spring is provided touching protrusions under both ends of the manipulation key, to give the manipulation key a force for restoration to its neutral position.

6 Claims, 7 Drawing Sheets

SEESAW MANIPULATION-TYPE VARIABLE RESISTOR

FIELD OF THE INVENTION AND RELATED ART STATEMENT

1. Field of the Invention

The present invention relates to a seesaw manipulation-type variable resistor. More particularly, it is concerned with seesaw manipulation-type variable resistors which are suitable for use in a miniature electronic device such as an integral-type video camera-cassette recorder.

2. Background of the Invention

Electronic components of a seesaw manipulation type are widely known as a switch which performs a switching operation by pivotally moving its manipulation key.

For instance, the seesaw manipulation switch disclosed in the Japanese unexamined Utility Model Publication (Jikkai-Sho) 57-173229 and illustrated by FIG. 6 to FIG. 9 is configured as follows. Namely, the disclosed seesaw manipulation switch has a manipulation key 5 which is pivotally supported by a supporting axis 4 at its upper part on a housing comprising a first casing 1 and a second casing 2. At the bottom part of the manipulation key 5, there is provided a brush-receiving plate 5*c* having thereon a set of electrically-conductive brushes 7 in a cantilever-fashion. At the bottom of the housing and on a side confronting said brush-receiving plate 5*c*, there is provided a base plate 8 with a plurality of sector-shaped fixed contacts 9 formed in a concentric pattern which corresponds to the pivotal movement region of the brush-receiving plate 5*c*. In this manner, the set of the brushes 7 are caused to resiliently touch the base plate 8. Further, a pair of spring-receiving plates 16 and 17 are mounted rotatably around the supporting axis 4 on the opposite side of the brush-receiving plate 5*c*, and a tension spring 18 is suspended between both ends of said pair of spring-receiving plates 16 and 17. In addition to this, a bent piece 1*a* laterally extended from the side wall of the first casing 1 and an engaging pin 5*e* planted on the brush-receiving plate 5*c* are inserted into a space formed between said pair of spring-receiving plates 16 and 17, and are caught by the plates.

In the above-mentioned prior art seesaw motion switch shown in FIGS. 6 to 9, when one end of the manipulation key 5 is pressed down, the manipulation key 5 and the brush-receiving plate 5*c* are simultaneously rotated around the supporting axis 4. With the attendant rotary sliding of the set of brushes 7 on the surface of the base plate 8, the contacting positions of the brushes 7 are changed with respect to each of the sector-shaped fixed contacts 9, accordingly. By this change of the contacting positions by a pressing of the manipulation key 5, the brushes 7 perform an intended switching operation by contacting the particular two of the plurality of the sector-shaped fixed contacts 9 (FIG. 7) to turn on a circuit connected to the particular two, or by departing from at least one of the contacts 9 to turn off a circuit connected to the one contact. During this switching operation, the engaging pin 5*e*, which is planted on the opposite side of the brush-receiving plate 5*c*, makes one of the spring-receiving plates 16 and 17 rotate against the urging by the tension spring 18.

When the pressing operation which had been exerted on the manipulation key 5 is removed, one of the spring-receiving plates 16 and 17 returns to its initial position by the resilient force of the tension spring 18, and then the brush 7 is also moved to its original and neutral position by the engaging pin 5*e*.

In recent years, there has been an increasing demand for a seesaw manipulation-type variable resistor that can steplessly adjust its resistance value, for instance for use in a video camera for its zooming speed controlling unit and the like.

The above-mentioned prior art seesaw manipulation-type switch may be used to some extent for this purpose if it would be converted to a variable resistor by forming a resistor element e.g. on its base plate 8 by means of a printing or the like process, instead of the fixed contacts 9. However, the proposed conversion of the prior art switch to a variable resistor has been found to be unsuitable for use in a miniature electronic device such as a video camera, because the conversion results in a large height of this variable resistor. The reason for the large height is that the variable resister has a configuration in that the base plate 8 is provided vertically with respect to the supporting axis 4 about which the manipulation key 5 is pivotally mounted, and the brush 7 interlocked with the movement of the manipulation key 5 is concentrically slid on the resistor element which is converted from the fixed contacts 9 on the surface of the base plate 8.

In order to reduce the height of the thus proposed seesaw manipulation-type variable resister, it is necessary to reduce the size of the base plate, hence, the sector-shaped resistor element formed thereon. But when the resistor element is designed to be small, it becomes difficult to accurately manufacture it to have the intended resistance value. Further, when the radius of the sector-shaped resistor element, i.e., the radius of rotary sliding of the brush 7 is designed to be small, an aberration of the resistor-printing pattern film may sometimes arise. And thus, there is brought such a hazard that the variance in the resistance value produced by the pressing stroke of the manipulation key becomes non-uniform by the printing aberration, between a right and left pressing stroke on the manipulation key.

In addition to these disadvantages, the abovementioned prior art seesaw manipulation-type variable resistor has been equipped with a complex mechanism with a number of parts and components for returning the manipulation key 5 to its neutral position, thereby inducing a high manufacturing cost.

SUMMARY AND OBJECTS OF THE INVENTION

The present invention is proposed for solving the problems inherent in the prior art devices, and has, as its object, a provision of the seesaw manipulation-type variable resistor that can make the size of its resistor element large while suppressing its height. It also has the advantage of a simple structure to its manipulation key-returning mechanism.

According to the present invention, there is provided a seesaw manipulation-type variable resistor comprising a base frame, a manipulation key which is pivotally supported, at its mid point, on the base frame and has an integrally-formed arm below the mid point, and a linear sliding-type variable resister unit provided under the base frame and having a coupling member which engages with the arm.

In the above-mentioned seesaw manipulation-type variable resistor, the integrally-formed arm of said manipulation key may have a U-shaped groove on its end, and the coupling member of the linear sliding-type variable resistor unit may be a laterally-extended rod which engages with the U-shaped groove.

In the above-mentioned seesaw manipulation-type variable resistor, the integrally-formed arm of said manipulation key may alternatively have a laterally-extended round rod, and the coupling member of the linear sliding-type variable resistor unit may be provided with a U-shaped groove which engages with the laterally-extended rod.

The above-mentioned seesaw manipulation-type variable resistor may further comprise a leaf spring accommodated in a space formed between the base frame and the manipulation key, its lengthwise ends fitting in, with a certain resiliency, a pair of confronting rectangular recesses provided on both end parts of the base frame; the leaf spring preferably touches with the under surfaces beneath the right and left manipulating region of the manipulation key for urging the manipulation key to return to its neutral position.

The above-mentioned seesaw manipulation-type variable resistor may further comprise at least one anti-vibration piece provided on at least one of the touching parts between the leaf spring and the manipulation key, and between the leaf spring and the base frame.

By the above-mentioned configuration, the seesaw manipulation-type variable resistor built in accordance with the present invention can be made to have a small height while having a sufficient effective length to the resistor element and linear enough for assuring an accurate resistance value, and thus the design and production of the resistor element having the intended resistance value become easy.

Further, the device in accordance with the present invention has an interlink mechanism between the manipulation key and the coupling member of the linear sliding-type variable resister in an engagement of the U-shaped groove provided on the arm of the manipulation key with a laterally extending round rod provided on the coupling member, with a laterally extending round rod provided on the arm of the manipulation key with the U-shaped groove of a coupling member of the variable resistor. Thereby, it has another advantage in that an excellent follow-up ability of the variable resistor for the manipulating direction and pressing stroke of the manipulation key and its assembling process is simple.

In addition to this, by providing at least one anti-vibration piece on at least one of the contacting parts between the leaf spring and the manipulation key or between the leaf spring and the base frame, the seesaw manipulation-type variable resistor has such a further advantage that the sound and vibration generated by the manipulation of the manipulation key are absorbed by these anti-vibration pieces. Therefore a stabilized manipulation is obtainable.

While the novel features of the present invention are set forth particularly in the appended claims, the invention, both as to organization and content, will be better understood and appreciated, along with other objects and features thereof, from the following detailed description taken in conjunction with the drawings.

Figure 1A:
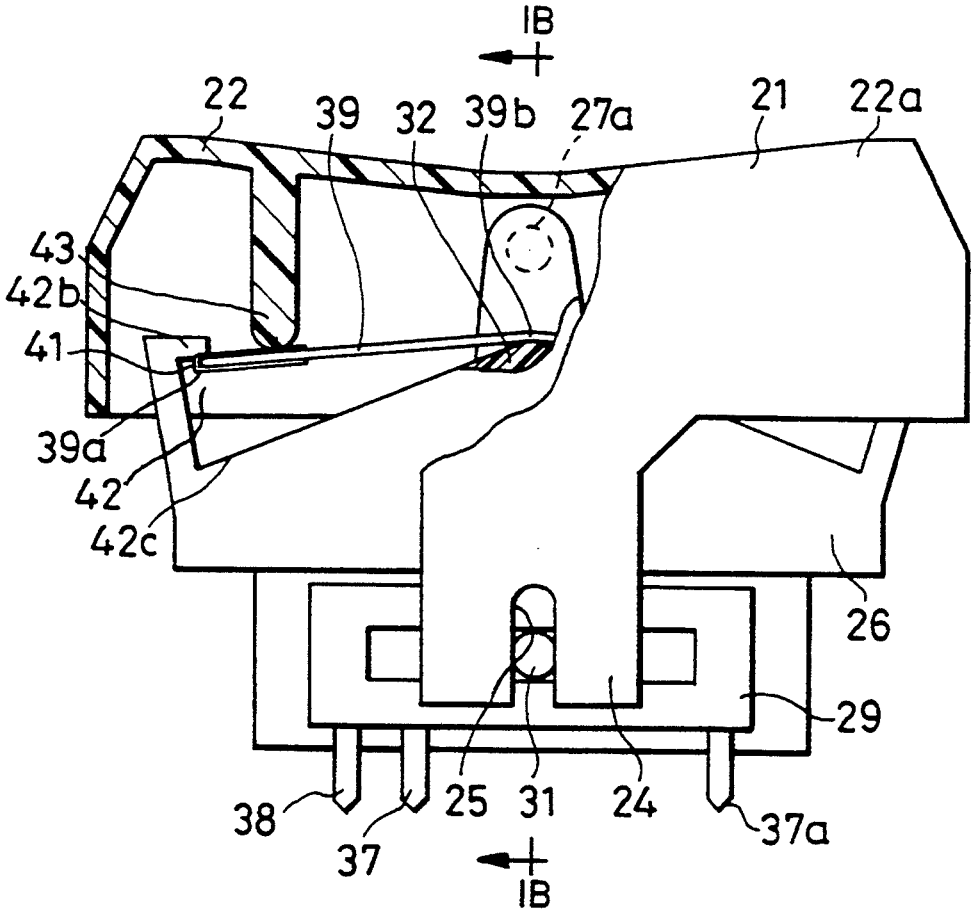
FIG. 1A is a partly cut-out front view of a seesaw manipulation-type variable resistor built in accordance with one embodiment of the present invention.
Figure 1B:
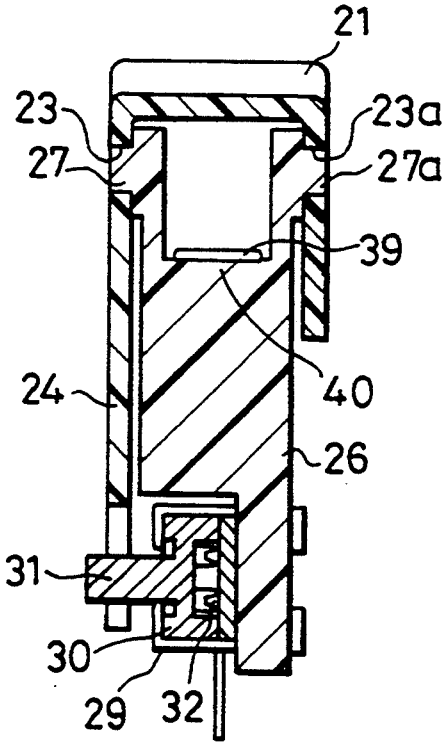
FIG. 1B is a cross-sectional side view of the seesaw manipulation-type variable resistor along a plane including the line 1B—1B of FIG. 1A.
Figure 2:
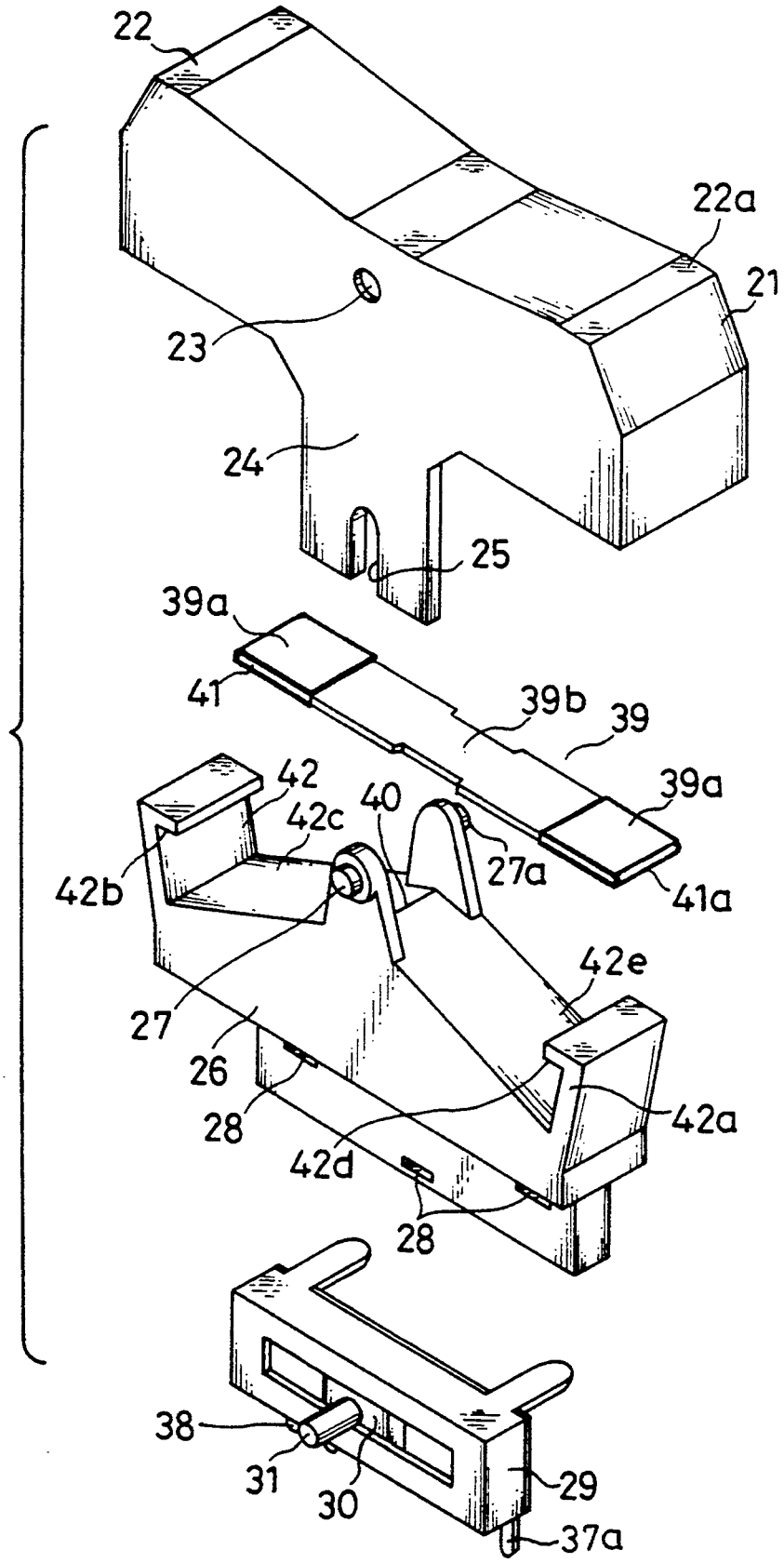
FIG. 2 is an exploded perspective view of the seesaw manipulation-type variable resistor shown in FIG. 1.

It will be recognized that some or all of the Figures are schematic representations the purposes of illustration and do not necessarily depict the actual relative sizes or locations of the elements shown.

DETAILED DESCRIPTION OF THE PREFERRED EMBODIMENTS

In the following paragraphs, the present invention will be described in more detail by way of examples with reference to the preferred embodiments shown in FIG. 1A, FIG. 1B, FIG. 2, FIG. 3, FIG. 4, FIG. 5A and FIG. 5B of the attached drawings.

As shown by these Figures, a manipulation key 21 made of a synthetic resin has a hollow structure with a generally arcuate top face and an integrally-formed downwardly extending arm 24 on one of the side walls. At the right and left end parts of the arcuate top face, as viewed in FIG. 1A, there are provided press-manipulating regions 22 and **22*a* which are symmetrical with respect to the center of the manipulation key 21. At the mid parts of the side wails of the manipulation key 21, there are provided through holes 23 and 23*a* which are coaxial with each other, for supporting axes 27 and 27*a*. The end of the arm 24 is shaped in a fork-edge having an open-end U-shaped groove 25**.

A base frame 26 is also made of a synthetic resin and has a pair of the supporting axes 27 and **27*a* which are coaxial with each other, on its upwardly extending arms. The supporting axes 27 and 27*a* fit in the through holes 23 and 23*a* of the manipulation key 21 for pivotally supporting the latter. The base frame 26 also carries a linear sliding-type variable resistor unit 29 on its downwardly extended part. A plurality of slots 28 are provided on the downwardly extended part for securing the variable resistor unit 29**.

The linear sliding-type variable resistor unit 29 has a slider 30 with a laterally-extending coupling member of round rod 31 which engages with the U-shaped groove 25 provided at the end of the arm 24 of the manipulation key 21 in a slightly pressed fit-in state. On the opposite side of the slider 30, there is held a sliding brush 32 whose contacts 33 are resiliently urged on the surface of the resistor base plate 34.

Figure 3:
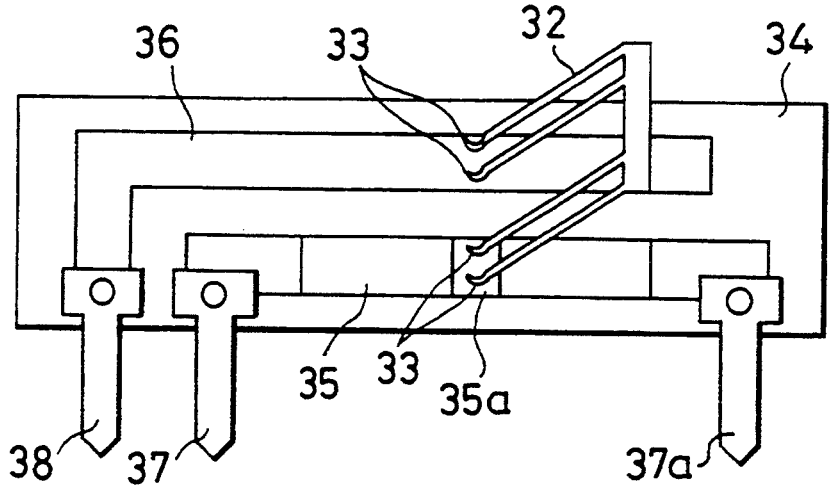
FIG. 3 is a plan view of the base plate including the resistor element of the seesaw manipulation-type variable resistor shown in FIG. 1.

The resistor base plate 34 is provided with a linear resistor layer 35 and a conductor layer 36 in parallel with each other, on its inner surface by means of a printing process or the like, as specifically shown by FIG. 3. The contacts 33 of the sliding brush 32 contact with the linear printed layers 35 and 36 in a manner that the sliding brush can make a short-circuit contact between both layers. On both ends of the resistor layer 35, connecting terminals 37 and 37*a* are conductively provided, and on one end of the conductor layer 36, a connecting terminal 38 is conductively provided, respectively.

Figure 4:
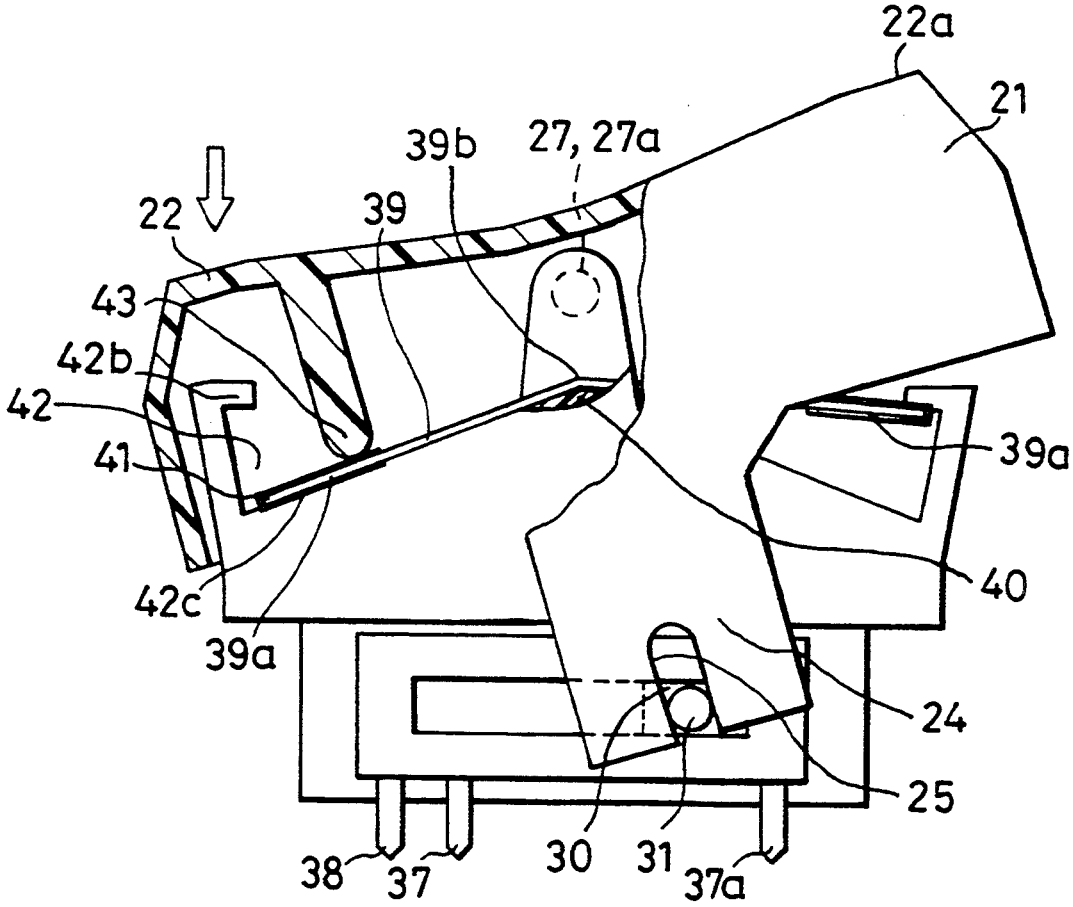
FIG. 4 is a partly cut-out front view of the seesaw manipulation-type variable resistor shown in FIG. 1, for illustrating its manipulating state.

A leaf spring 39 made of a resilient thin plate of metal such as carbon steel or phosphor bronze is accommodated in a space formed between the manipulation key 21 and the base frame 26, and is supported, at its midpoint part 39*b*, on an apex 40 provided on the base frame 26 between its upwardly extending arms, as specifically shown in FIG. 4. Both ends 41 and 41*a* of the leaf spring 39 are fit in a pair of rectangular recesses 42 and 42*a* with a certain resiliency.

Both distal ends of protrusions 43 (only one protrusion 43 is shown in FIG. 4) provided beneath left and right press-manipulating regions 22 and 22*a* on the under face of the manipulation key 21 as viewed in FIG. 4 are contacting with both end portions of the upper surface of the leaf spring 39. Thus, in a normal state, the leaf spring 39 is constantly maintaining the manipulation key 21 to its horizontal state, i.e., the neutral position, as shown by FIG. 1. A pair of anti-vibration pieces 39*a* are provided to cover both end parts of the leaf spring 39 which touch the tips of the above-mentioned protrusions 43.

In this state, the slider 30 of the linear sliding-type variable resistor unit 29 is held at its neutral position in the sliding stroke through the coupling member 31 which is engaging with the U-shaped groove 25 of the end of the arm 24. The sliding brush 32 held by the slider 30 is located at the mid position 35*a* in the linear printed layers 35 and 36, as specifically illustrated by FIG. 3.

In the following paragraphs, the operation of the thus configured seesaw manipulation-type variable resister will be illustrated with reference to FIG. 4. FIG. 4 shows a case of press-manipulating the manipulation key 21 against the urging by the resiliency of the leaf spring 39. The pressing causes the linear sliding type variable resister 29 to operate to adjust its resistance value.

When one of the press manipulating regions 22 and 22*a* of the manipulation key 21 is pressed down in the direction indicated by an arrow in FIG. 4, the manipulation key 21 rotates around the supporting axes 27 and 27*a*; and the tip of the protrusion 43 provided beneath the press manipulating region 22 presses the touching region of the leaf spring 39 down. Since the leaf spring 39 is held in the base frame 26 on its apex 40 as a fulcrum, it can bend its left half down as viewed in FIG. 4, departing from an upper retainer claw 42*b* of the rectangular recess 42 and reaching the location whereat it touches a lower stopper region 42*c*.

At that time, the arm 24 of the manipulation key 21 is also rotated around the supporting axes 27 and 27*a*, and drives the coupling member 31 of the linear sliding-type variable resistor unit 29 to slide along the U-shaped groove 25 toward its tip. Thereby the coupling member 31 engaging with the U-shaped groove 25 rotates. Accordingly, the slider 30 moves toward the right as viewed in FIG. 4. Then, the sliding brush 32 held on the opposite side of the slider 30 slides along the linear resistor layer 35 and the conductor layer 36 of the resistor base plate 34, and short-circuits both layers 35 and 36. In this manner, the operation causes the resistance value between the connecting terminals 37 and 38 to increase (the resistance value between the connecting terminals 37*a* and 38 to decrease) in compliance with the amount of press-down stroke applied to the press manipulating region 22 of the manipulation key 21.

When the pressing down force exerted on the press manipulating region 22 of the manipulation key 21 is removed, the manipulation key 21 returns to its original position by the resiliency of the leaf spring 39 transmitted through the protrusion 43; and the sliding brush 32 also returns to its neutral position.

On the other hand, when the other press manipulating region 22*a* of the manipulation key 21 is pressed down by exerting a pressing force, this operation causes the resistance value between the connecting terminals 37*a* and 38 to increase (and the resistance value between the connecting terminals 37 and 38 to decrease) in compliance with the amount of press-down stroke applied to press manipulating region 22*a* of the manipulation key 21.

Figure 5A:
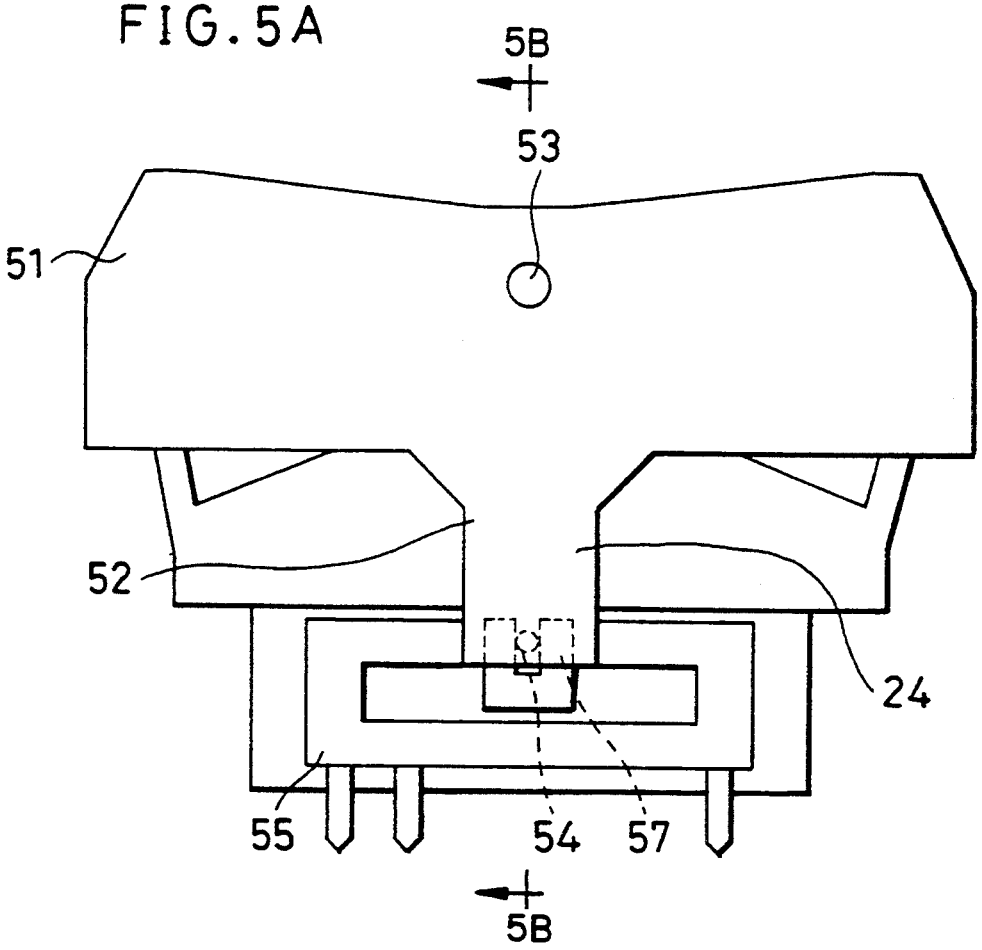
FIG. 5A is a partly cut-out front view of a seesaw manipulation-type variable resistor built in accordance with another embodiment of the present invention.
Figure 5B:
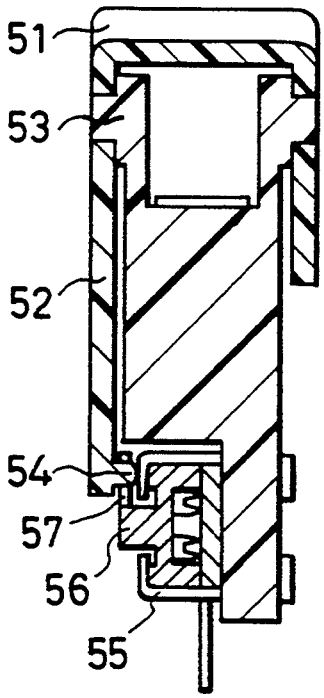
FIG. 5B is a cross-sectional side view of the seesaw manipulation-type variable resistor along a plane including the line 5B—5B of FIG. 5A.
Figure 6:
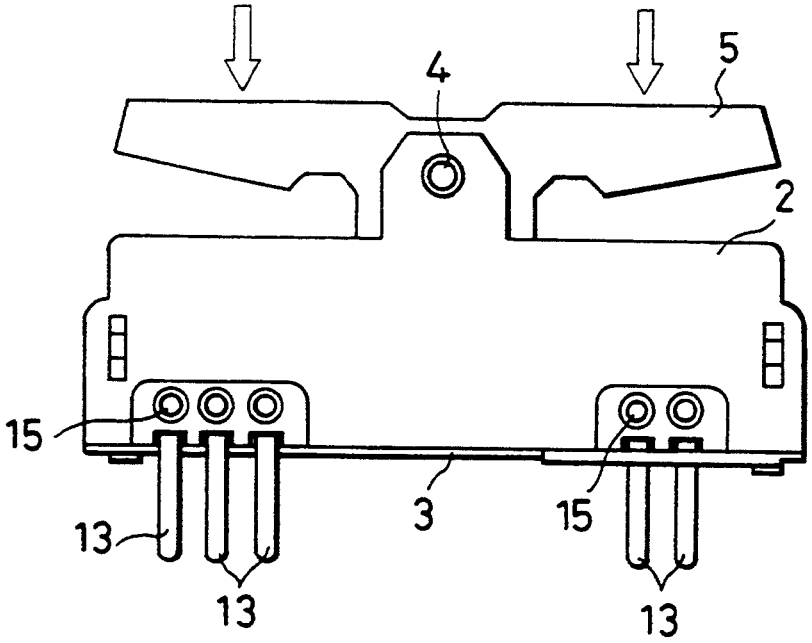
FIG. 6 (PRIOR ART)
FIG. 6 is a front view of the prior art seesaw manipulation-type switch.
Figure 7:
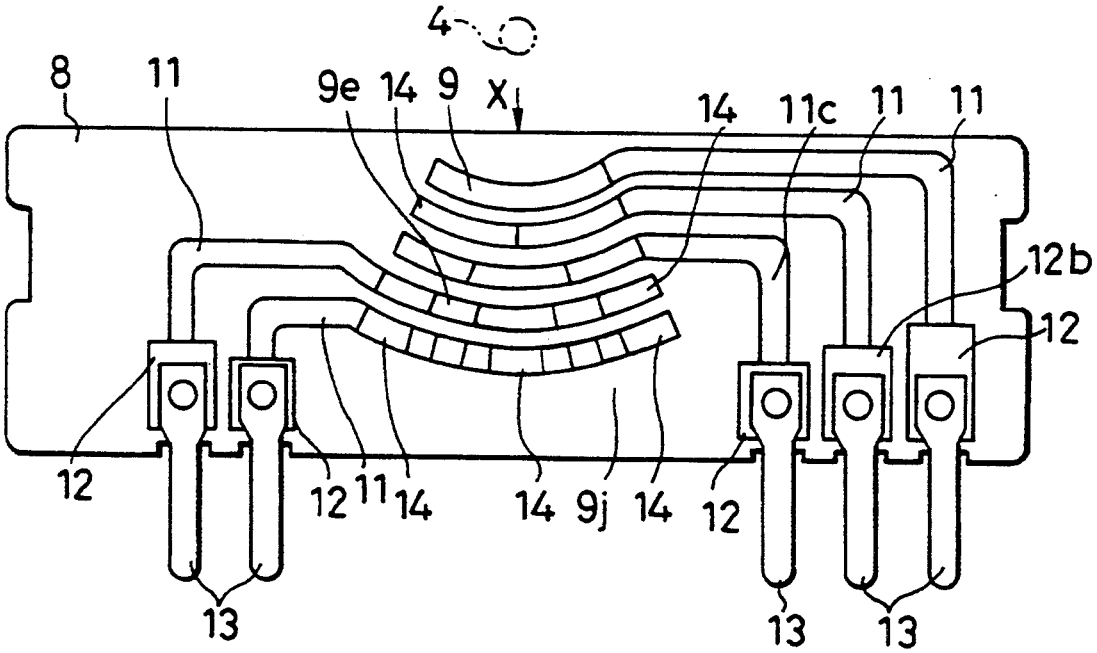
FIG. 7 (PRIOR ART)
FIG. 7 is a plan view of the base plate including the contacts and resistor elements of the prior art seesaw manipulation-type switch.
Figure 8:
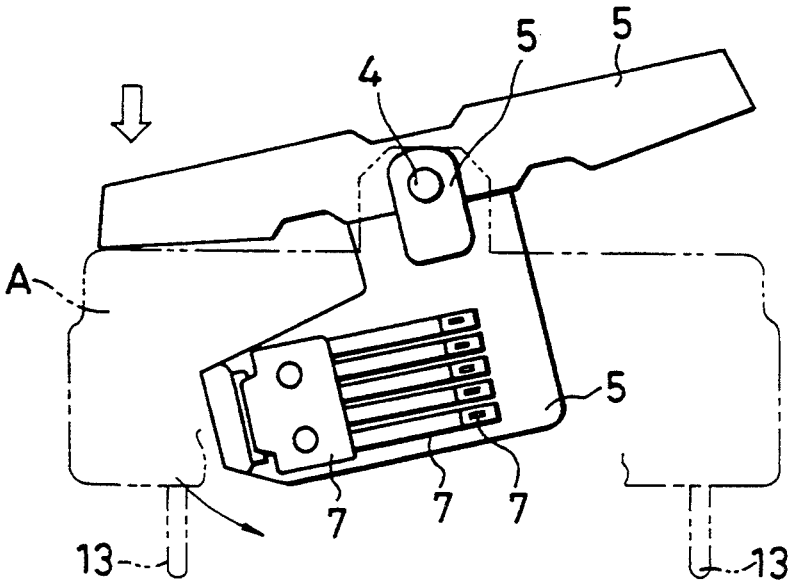
FIG. 8 (PRIOR ART)
FIG. 8 is a partly removed front view of the seesaw manipulation-type switch shown in FIG. 6, for illustrating its manipulating state.
Figure 9:
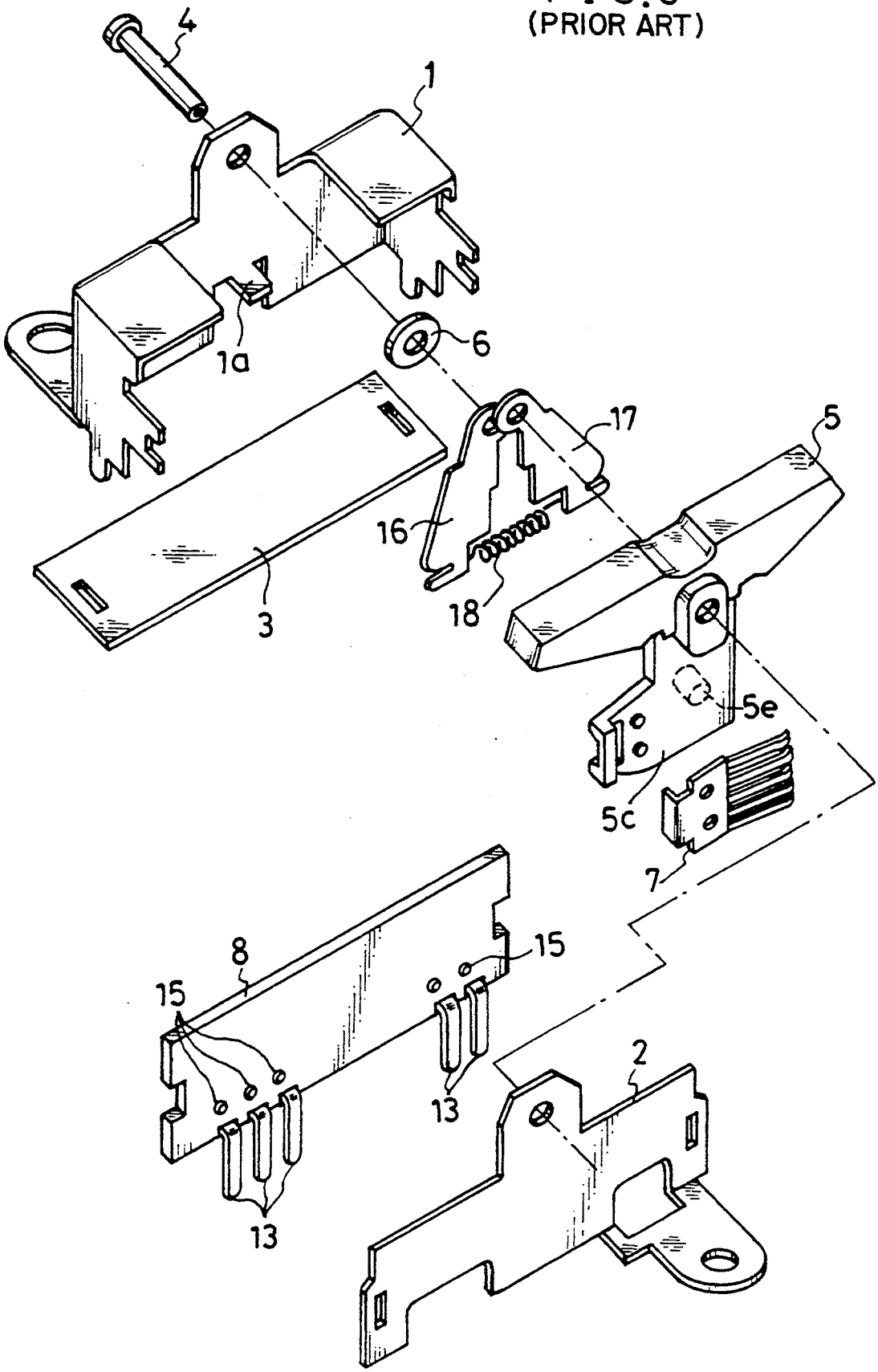
FIG. 9 (PRIOR ART)
FIG. 9 is an exploded perspective view of the seesaw manipulation-type switch shown in FIG. 6.

FIG. 5A and FIG. 5B show a seesaw manipulation-type variable resistor built in accordance with another embodiment of the present invention. Different from the foregoing embodiment, in this embodiment a laterally and inwardly extending rod 54 is provided parallel with a supporting axis 53 on the tip of an arm 52 of a manipulation key 51, and further, a U-shaped groove 57 is provided so as to engage with the rod 54 on a coupling member 56 of a linear sliding-type variable resistor unit 55.

According to the Embodiments of the present invention, the motions of the manipulation key 21 or 51 and the arm 24 or 52 of the manipulation key 21 or 51 are driven so as to associate with the coupling member 31 or 56 of the linear sliding-type variable resistor unit 29 or 55. Thereby, the height of the resulting seesaw manipulation-type variable resistor can be made small. In addition to this, since the resistor element or layer 35 can be formed linearly, the manufacture of a resistor element to have the intended accurate resistance value becomes easy.

Further, the seesaw manipulation-type variable resistor of the present invention has a very simple structure and can be configured such that the retaining of the manipulation key 21 to its neutral position is performed by the leaf spring 39, which is supported at its mid part 39*b*, on the apex 40 of the base frame 26. The leaf spring 39 is assembled in the base frame 26 by fitting of its ends 41 and 41*a* in both of the rectangular recesses 42 and 42*a*, respectively, of the base frame 26. The leaf spring 39 is caused to touch the protrusions 43 of the manipulation key 21.

In addition to this, although the abovementioned anti-vibration pieces 39*a* are illustrated in the foregoing embodiment as being provided on the leaf spring 39, they may alternatively be provided on the protrusions 43 and the rectangular recesses 42 and 42*a* of the base frame 26, or the upper retainer claws 42*b* and 42*d*, and the lower stopper regions 42*c* and 42*e*.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. A seesaw manipulation-type variable resistor comprising:

a base frame;

a manipulation key pivotally supported, at a midpoint, on said base frame and has an integrally-formed arm below said midpoint;

a linear sliding-type variable resistor unit provided under said base frame and having a coupling member which engages with said arm;

a leaf spring accommodated in a space formed between said base frame and said manipulation key, said leaf spring having two lengthwise ends resiliently fitting in confronting rectangular recesses provided in each of two lateral ends of said base frame;

said leaf spring touching under surfaces of said two lateral ends of said manipulation key for urging said manipulation key to return to a neutral position; and at least one anti-vibration piece provided on at least one of said touching parts of said leaf spring between the leaf spring and the manipulation key.

2. The seesaw manipulation-type variable resistor according to claim 1, wherein:

said integrally-formed arm of said manipulation key has a U-shaped groove on its end; and said coupling member of said linear sliding-type variable resistor unit is a laterally-extended rod which engages with said U-shaped groove.

3. The seesaw manipulation-type variable resistor according to claim 1, wherein:

said integrally-formed arm of said manipulation key has a laterally-extended round rod; and said coupling member of said linear sliding-type variable resistor unit is provided with a U-shaped groove which engages with said laterally-extended rod.

4. The seesaw manipulation-type variable resistor according to claim 1 or 2, wherein said coupling member of the linear sliding-type variable resistor unit is a round rod.

5. A seesaw manipulation-type variable resistor comprising:

a base frame;

a manipulation key pivotally supported at a midpoint on said base frame, said manipulation key having an integrally-formed arm below said midpoint;

a linear sliding-type variable resistor unit provided under said base frame, said linear sliding variable resistor having a coupling member which engages with said arm;

a leaf spring accommodated in a space formed between said base frame and said manipulation key, said leaf spring having two lengthwise ends resiliently fitting in two confronting rectangular recesses provided in each of two lateral ends of said base frame, said leaf spring touching under surfaces of said two lateral ends of said manipulation key for urging said manipulation key to return to a neutral position; and an anti-vibration piece provided between the leaf spring and the manipulation key.

6. A seesaw manipulation-type variable resistor according to claim 5 further comprising an anti-vibration piece provided between said leaf spring and said base frame.

* * * * *